US005625895A

United States Patent [19]

Sovereign

[11] Patent Number: 5,625,895

[45] Date of Patent: May 6, 1997

[54] GARMENT FOR PROTECTING THE BUTTOCKS OF A WEARER WHEN SEATED

[76] Inventor: Lewis V. Sovereign, 293 Ottawa Avenue, Winnipeg, Manitoba, Canada, R2K 1K6

[21] Appl. No.: 592,853

[22] Filed: Jan. 24, 1996

Related U.S. Application Data

[63] Continuation of Ser. No. 505,754, Jul. 21, 1995, abandoned.

[51] Int. Cl.[6] ..... A41D 13/00; A47C 1/00

[52] U.S. Cl. ..... 2/467; 2/22; 297/4; 224/662; 224/677; 224/683

[58] Field of Search ..... 2/2, 22, 23, 94, 2/48; 224/224, 226, 151, 253; 5/417, 420, 653, 656; 297/4

[56] References Cited

U.S. PATENT DOCUMENTS

| | | |
|---|---|---|
| 139,950 | 6/1873 | Garund . |
| 3,185,362 | 5/1965 | Wakefield . |
| 4,588,224 | 5/1986 | Hill, Jr. . |
| 4,923,247 | 5/1990 | Malmstrom . |
| 4,955,665 | 9/1990 | Richer . |
| 5,271,659 | 12/1993 | Zinkevicz . |
| 5,275,315 | 1/1994 | Carmack et al. . |

*Primary Examiner*—Paul C. Lewis
*Attorney, Agent, or Firm*—Adrian D. Battison; Murray E. Thrift

[57] ABSTRACT

A garment for use by a wearer when seated comprises a waist band with a rectangular pad depending downwardly from the rear of the waist band having a width to extend around the rear of the wearer and a depth to extend downwardly beyond the crotch of the wearer. On an inner or front surface of the pad is provided a utility pocket with a bottom edge of the pocket at the bottom edge of the pad and a pocket arranged centrally with a top edge of the pocket below the crotch of the wearer so that the pocket is presented forwardly between the legs of the wearer when the wearer is seated. On the outside of the pad is provided a transparent plastic cover defining a pocket for receiving printed information such as a sports logo with the upper edge of the pocket at the waist band so that the pocket is closed by pulling the waist band around the waist of the wearer.

8 Claims, 2 Drawing Sheets

GARMENT FOR PROTECTING THE BUTTOCKS OF A WEARER WHEN SEATED

This application is a continuation application of application Ser. No. 08/505,754, filed Jul. 21st, 1995 which now stands abandoned.

BACKGROUND OF THE INVENTION

This invention relates to a garment which can be wrapped around the waist of a wearer and provides a pad depending downwardly from the waistband for protecting the buttocks of the wearer when seated.

It is known to provide a device which has a waist band with a fastener for engaging around the waist of the wearer and a depending pad at the rear of the waist band having a width of the order of 24 inches and a depth of the order of 24 inches so that when the wearer sits, the pad protects the buttocks.

However this devices is of limited commercial marketability since it is strictly utilitarian and relatively unattractive so that there is a significant resistance to the wearer in wearing the product.

SUMMARY OF THE INVENTION

It is one object of the present invention to provide an improved garment of this general type which enhances its utility and enhances its wear ability so as to provide a significantly increased incentive for the wearer to utilize the product.

According to one aspect of the invention there is provided a garment comprising a waist band with fastening means for engaging around the waist of a wearer; a flat seat pad having an upper edge attached to the waist band for support thereby, a lower edge substantially parallel to the upper edge and two side edges each extending from the upper edge to the lower edge, the side edges being spaced to define a width of the pad sufficient to engage across the buttocks of a wearer, the lower edge being spaced from the upper edge by a distance sufficient to depend below the crotch of the wearer, the pad having an inner surface for engaging against the buttocks of the wearer and an opposed outer surface; a transparent moisture impermeable covered layer on the outer surface having three sides edges attached to the pad and a fourth upper edge at the waistband which is open to define a pocket between the pad and the cover layer for receiving a printed sheet and a pocket on the inner surface having a bottom edge of the pocket at the lower edge of the pad and a top edge of the pocket spaced downwardly from the upper edge of the pad by a distance so as to be accessible between the legs of the wearer when the wearer is seated.

The device therefore comprises a sporting goods garment with numerous features of mass appeal. Originally the idea was simply to provide a device which protected the buttocks of the wearer to provide a warm dry seat during outdoor sporting events or the like. The improved design allows for "hands free" use. The device provides a number of features as follows:

The pile side against the skin provides warmth and comfort. The vinyl side facing out is water repellent. A clear pocket on the back provides space for logos, messages, etc.. A utility pocket on the inside centre provides multiple uses. Elastic waist band and clasp adds to simplicity and ease of manufacture. The device can be used in the following market.

1. All sport teams both professional and amateur.
2. Fisherman—hook remover in the utility pocket—boat fishermen.
3. Hunters—Game call in utility pocket.
4. Golf fans—great for sitting on ground in galleys encourage player of choice or get more mileage from sponsors.
5. Beach goers—protects clothes from sand.
6. Bird watchers—binoculars in utility pocket.
7. Skiers—for riding lifts in shorts.
8. Company sponsored events, tournaments etc. allows visible endorsement.
9. Races—all grand stand type.
10. Soccer, baseball, football, hockey etc.

The concept of making the product in a variety of sports team colors and mass selling at pro games was originally perceived as the largest market.

The baggy garment aspects suits today's androgynous fashion. The utility aspect provides benefit to every user market. The clear acrylic message pocket allows company, team and individual messaging.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

The apparatus comprises an elastic waist band 10 at a width of the order of 1 to 1½ inches with a male fastening and a female fastening 12 which allows the waist band to be clamped around the waist of the wearer to hold the waist band in place at the waist of the wearer.

Figure 1:
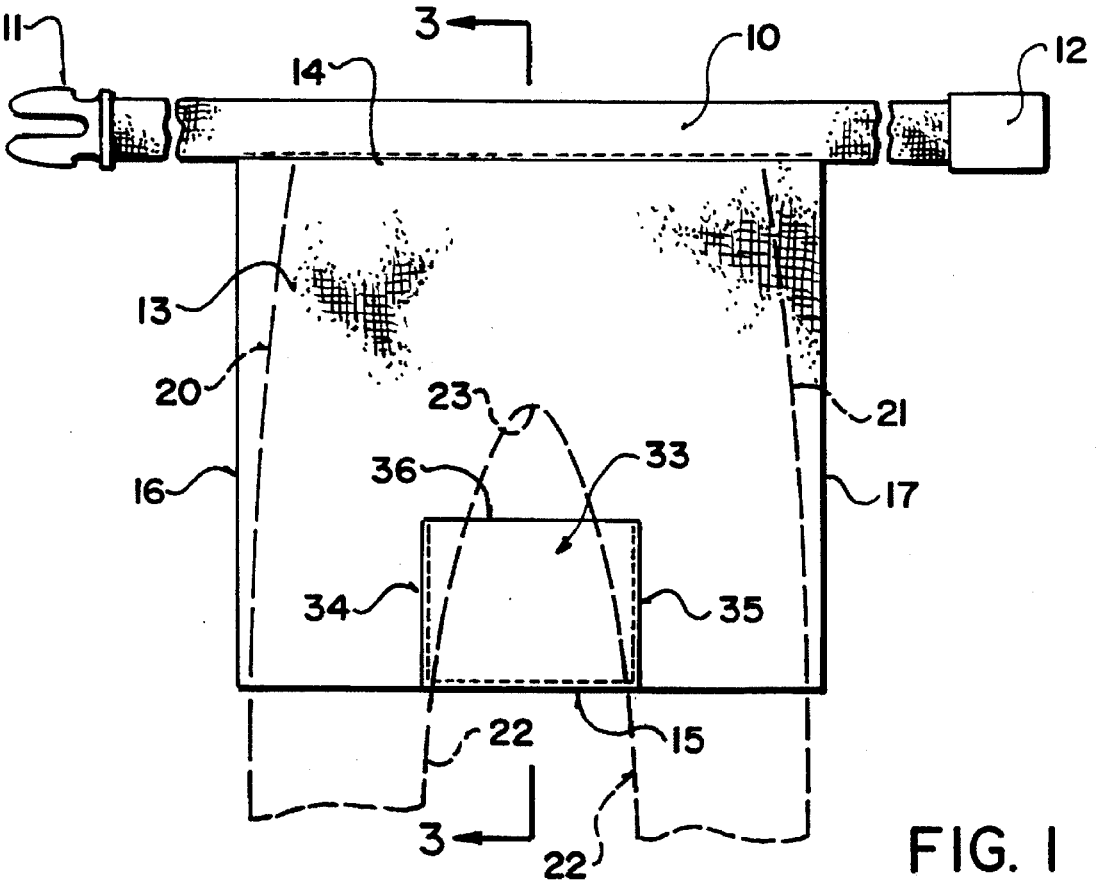
FIG. 1 is a front elevational view of the garment according to the present invention.
Figure 2:
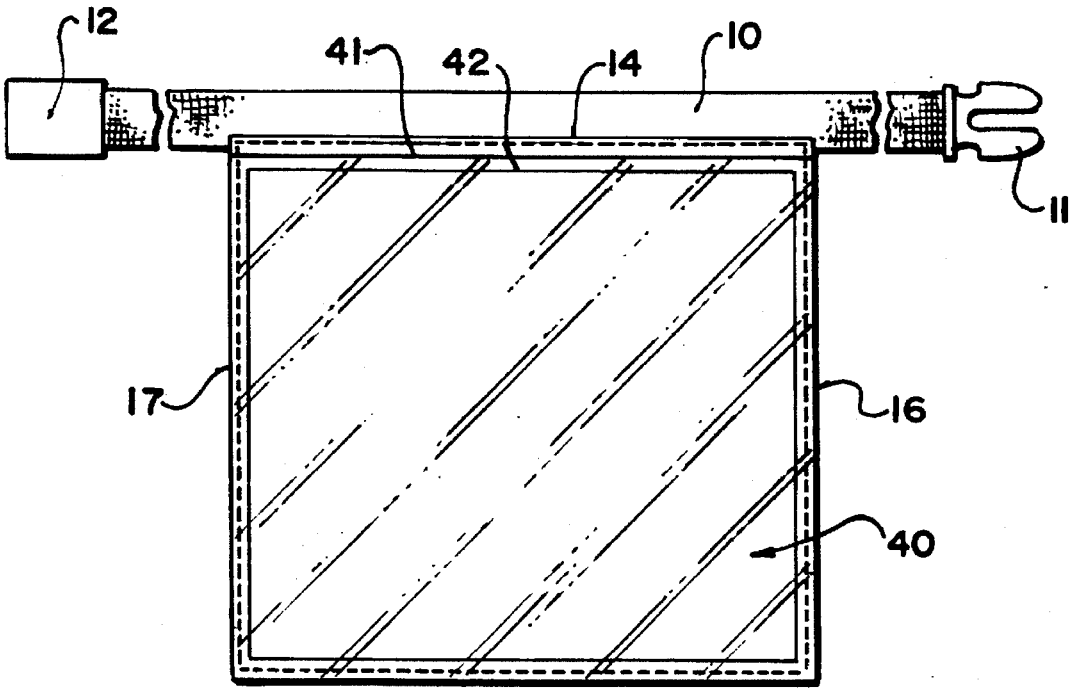
FIG. 2 is a rear elevational view of the garment of FIG. 1.

At the rear of the waist band is provided a flat seat pad 13 having an upper edge 14 attached by stitching directly to the lower edge of the waistband. The pad further includes a lower edge 15 parallel to the upper edge and spaced from the upper edge by the depth of the pad. The pad further includes side edges 16 and 17 which are parallel so as to form a generally rectangular shape only with each side edge extending from the waist band to the lower edge and defining a width of the pad. Approximately the width of the pad is in the range 18 to 214 inches and preferably of the order of 22 inches so as to wrap around the rear and sides of the buttocks of an average wearer to provide an adequate seating pad when the wearer sits. The pad has a depth greater than 18 inches and preferably of the order of 24 inches which is greater than the normally required depth for the buttocks and extends down below the crotch of the wearer. In FIG. 1, the position of the garment relative to the body of a wearer is indicated schematically in dotted line where the sides of the wearer are indicated at 20 and 21 and the inside of the thigh of the wearer is indicated at 22 extending to a crotch 23. It will be noted therefore that the pad covers the buttocks of the wearer from the waist band to the crotch and depends downwardly beyond the crotch in the form of a skirt covering only the rear of the wearer.

Figure 3:
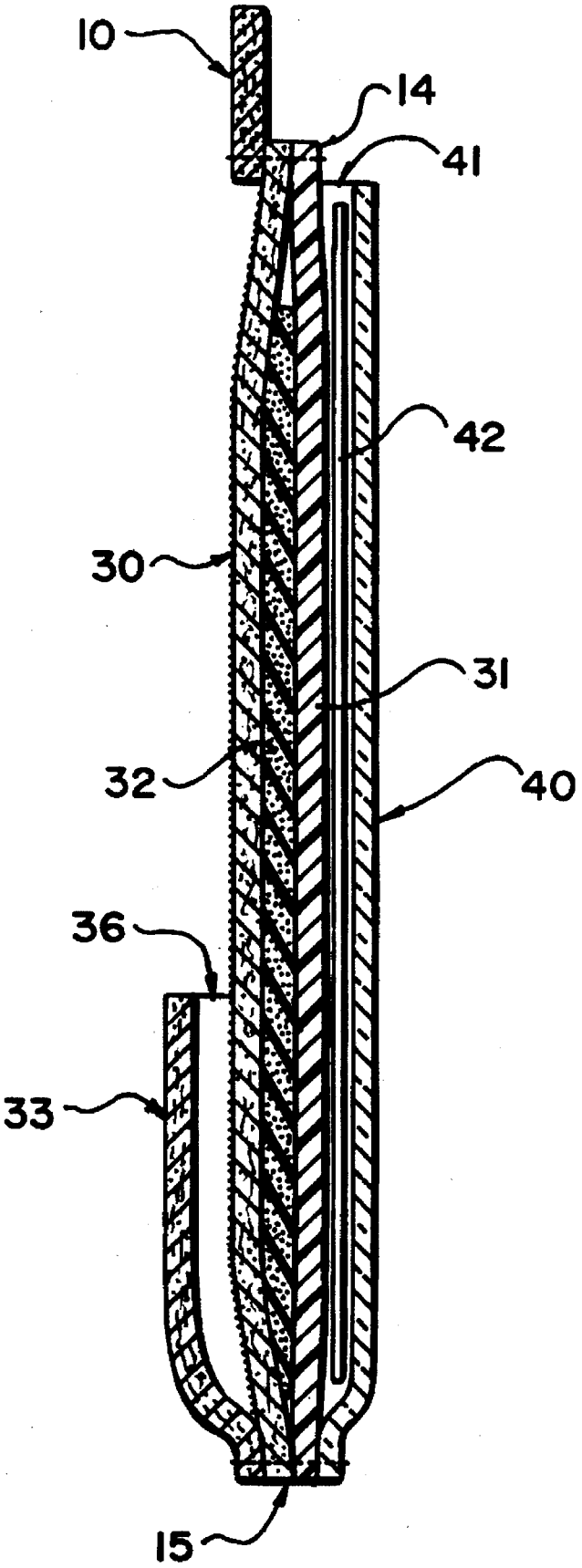
FIG. 3 is a cross sectional view along the lines 3—3 of FIG. 1.

As shown in FIG. 3, the pad is formed from an inner layer 30 of a fleece fabric, an outer layer 31 of a water impermeable fabric and a central layer 32 of a foam padding of the order of 0.25 inches thickness.

On the inside surface at the centre of the lower edge 15 is provided a utility pocket 33 formed of a fabric material such as stretch denim. The pocket is of a width less than the lower edge 15 with a lower edge of the pocket at the lower edge and with side edges of the pocket 34 and 35 spaced inwardly of the side edges of the pad. An upper edge 36 of the pocket is open to allow insertion of elements to be transported by the wearer.

The position of the pocket and its location at the bottom edge of the pad which is below the crotch 23 of the wearer allows the pocket to be exposed for use particularly when the wearer is seated with the wearer's legs apart thus presenting the pocket forwardly of the seat bottom on which the wearer is seated depending downwardly between the legs of the wearer. This makes the pocket readily available for use when the pad is in use with the wearer seated on the pad.

On the outside surface of the pad is provided a pocket 40 of a transparent plastics material. The pocket 40 has an upper edge 41 at the upper edge of the pad so that the upper edge 41 is pulled closed by the wrapping of the waist band around the waist of the wearer. In the embodiment shown the pocket 40 has bottom and side edges coincidental with the lower and side edges of the pad to form a pocket covering the full outside surface of the pad. The pocket can therefore receive printed materials schematically indicated at 42 for example a sports club logo. The printed material is exposed through the transparent pocket thus exposing the club logo or the printed material covering the buttocks of the wearer.

In an alternative arrangement the pocket may be reduced in size so that it extends only partly downwardly and across the pad from the top edge 41 at the upper edge of the pad thus for example providing a smaller logo sheet which covers only the buttocks rather than depending downwardly beyond the buttocks.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A garment comprising a waist band with fastening means for engaging around the waist of a wearer; a flat seat pad having an upper edge attached to the waist band for support thereby, a lower edge substantially parallel to the upper edge and two side edges each extending from the upper edge to the lower edge, the side edges being spaced to define a width of the pad sufficient to engage across the buttocks of a wearer, the lower edge being spaced from the upper edge by a distance sufficient to depend below the crotch of the wearer, the pad having an inner surface for engaging against the buttocks of the wearer and an opposed outer surface; a transparent moisture impermeable cover layer on the outer surface having three sides edges attached to the pad and a fourth upper edge at the waistband which is open to define a first pocket between the pad and the cover layer for receiving a printed sheet and a second pocket on the inner surface having a bottom edge of the second pocket at the lower edge of the pad and a top edge of the second pocket spaced downwardly from the upper edge of the pad by a distance so as to be accessible between the legs of the wearer when the wearer is seated.

2. The garment according claim 1 wherein the cover layer covers the full area of the outer surface of the pad.

3. The garment according to claim 1 wherein the second pocket has a width less than that of the pad and is arranged at a center part of the pad.

4. The garment according to claim 1 wherein the pad comprises an inner fleece layer and a water impermeable outer layer.

5. The garment according to claim 4 including a foam liner between the fleece layer and the water impermeable outer layer.

6. The garment according to claim 1 wherein the width of the pad between the sides edges lies in the range 18 to 24 inches.

7. The garment according to claim 1 wherein the pad has a depth from the upper edge to the lower edge greater than 18 inches.

8. The garment according to claim 1 wherein the pad has a depth from the upper edge to the lower edge of the order of 24 inches.

* * * * *